US007945186B2

(12) United States Patent
Kimura

(10) Patent No.: US 7,945,186 B2
(45) **Date of Patent: *May 17, 2011**

(54) IMAGE FORMING APPARATUS INCLUDING A HEAT SHIELDING DEVICE

(75) Inventor: Takayuki Kimura, Ohta-ku (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/129,313

(22) Filed: May 29, 2008

(65) Prior Publication Data

US 2008/0232872 A1 Sep. 25, 2008

Related U.S. Application Data

(60) Division of application No. 11/143,893, filed on Jun. 3, 2005, now Pat. No. 7,418,217, which is a continuation of application No. 10/244,706, filed on Sep. 17, 2002, now Pat. No. 6,922,538.

(30) Foreign Application Priority Data

Sep. 17, 2001 (JP) ..... 2001-282231

(51) Int. Cl.
*G03G 21/20* (2006.01)

(52) U.S. Cl. ..... 399/92; 399/94

(58) Field of Classification Search ..... 399/92, 399/94, 331

See application file for complete search history.

(56) References Cited

U.S. PATENT DOCUMENTS

| | | | | |
|---|---|---|---|---|
| 4,542,980 | A | | 9/1985 | Tajima |
| 5,114,818 | A | | 5/1992 | Yu |
| 5,303,018 | A | | 4/1994 | Terada et al. |
| 5,390,006 | A | | 2/1995 | Wakabayashi et al. |
| 5,606,408 | A | | 2/1997 | Yano et al. |
| 5,740,494 | A | | 4/1998 | Shoji et al. |
| 5,752,129 | A | | 5/1998 | Sugiyama |
| 5,765,087 | A | | 6/1998 | Yano et al. |
| 6,049,692 | A | * | 4/2000 | Hwang ..... 399/333 |
| 6,151,466 | A | | 11/2000 | Fujiwara |
| 6,167,230 | A | | 12/2000 | Kimura et al. |
| 6,240,265 | B1 | | 5/2001 | Noh |
| 6,243,550 | B1 | | 6/2001 | Fuchiwaki et al. |
| 6,292,647 | B1 | | 9/2001 | Ishida |

(Continued)

FOREIGN PATENT DOCUMENTS

JP 04-134387 5/1992

(Continued)

*Primary Examiner* — David M Gray

*Assistant Examiner* — Andrew V Do

(74) *Attorney, Agent, or Firm* — Oblon, Spivak, McClelland, Maier & Neustadt, L.L.P.

(57) ABSTRACT

An image forming apparatus includes an image forming device that forms a toner image on a recording medium, a heat fixing device provided adjacent to the image forming device to fix the toner image onto the recording medium by heat, and a heat shielding device that shields the image forming device from the heat radiated from the heat fixing device. The heat shielding device includes a heat shielding member interposed between the image forming device and the heat fixing device to receive the heat radiated from the heat fixing device, a heat transferring member attached to the heat shielding member to transfer the heat received by the heat shielding member to one end portion thereof, a heat radiating fin device provided at the one end portion of the heat transferring member to radiate the transferred heat, and a fan that supplies air to the heat radiating fin device.

22 Claims, 7 Drawing Sheets

U.S. PATENT DOCUMENTS

| | | | | |
|---|---|---|---|---|
| 6,308,026 | B1 * | 10/2001 | Kouchi | 399/110 |
| 6,438,348 | B2 | 8/2002 | Kobaru et al. | |
| 6,898,410 | B2 * | 5/2005 | Boss | 399/330 |
| 2002/0136561 | A1 | 9/2002 | Izumi et al. | |

FOREIGN PATENT DOCUMENTS

| | | | |
|---|---|---|---|
| JP | 05-134571 | | 5/1993 |
| JP | 05-165355 | | 7/1993 |
| JP | 05-341677 | | 12/1993 |
| JP | 08-022227 | | 1/1996 |
| JP | 8-220952 | | 8/1996 |
| JP | 09-171311 | | 6/1997 |
| JP | 10-322071 | | 12/1998 |
| JP | 11-015308 | | 1/1999 |
| JP | 11231760 | A * | 8/1999 |
| JP | 11-338333 | | 12/1999 |
| JP | 11-344916 | | 12/1999 |
| JP | 2000-216580 | | 8/2000 |
| JP | 2000-275975 | | 10/2000 |
| JP | 2000-293090 | | 10/2000 |
| JP | 2000284613 | A | 10/2000 |
| JP | 2001-13855 | | 1/2001 |

* cited by examiner

IMAGE FORMING APPARATUS INCLUDING A HEAT SHIELDING DEVICE

CROSS-REFERENCE TO RELATED APPLICATIONS

The present application is a divisional of application Ser. No. 11/143,893 filed on Jun. 3, 2005, which is a continuation application of application Ser. No. 10/244,706, filed Sep. 17, 2002, now U.S. Pat. No. 6,922,538, and which also claims priority to Japanese Patent Application No. 2001-282231 filed in the Japanese Patent Office on Sep. 17, 2001, the contents or each of which is incorporated herein by reference.

BACKGROUND OF THE INVENTION

1. Field of the Invention

The present invention relates to an electrophotographic image forming apparatus such as a copying machine, a facsimile machine, a printer, or other similar image forming apparatus, and more particularly to an image forming apparatus including a heat shielding device that shields an image forming device from heat radiated from a heat fixing device.

2. Discussion of the Background

An electrophotographic image forming apparatus generally includes an image forming device having a photoreceptor, a charging device, a developing device, a transfer device, a cleaning device to perform an electrophotographic process; a heat fixing device that fixes a toner image on a transfer sheet; an image reading optical system that reads an image of an original document; an image writing optical system that writes image information onto the photoreceptor; and a sheet feeding device that feeds a transfer sheet to the image forming device.

The heat fixing device includes a heat roller having a heater inside thereof and a pressure roller press-contacted onto the heat roller. A toner image, which is transferred onto a transfer sheet in the image forming device, is fixed onto the transfer sheet by heat and pressure in the heat fixing device.

Due to an increasing demand for downsizing an image forming apparatus, devices in \ the image forming apparatus tend to be provided close to each other. Accordingly, an image forming device and a heat fixing device tend to be located adjacent to each other. In this case, elements in the image forming device may tend to be badly influenced by heat radiated from the heat fixing device. For example, in a developing device that contains toner, the toner in the developing device is likely to cohere due to the heat generated in the heat fixing device. In a cleaning device, if the toner collected by the cleaning device coheres due to the heat generated in the heat fixing device, the collected toner may not be conveyed smoothly.

In order to prevent an image forming device from heat radiated from a heat fixing device, for example, Japanese Laid-open Patent Publication No. 11-344916 describes an image forming apparatus including a heat shielding device in which an amount of heat transmitted from a heat fixing device to an image forming device is reduced by use of a heat shielding plate provided with heat pipes. As compared to a heat shielding device using an air duct or a heat sink, the size of the apparatus may be reduced by using the heat shielding plate and heat pipes.

An image forming apparatus including a heat shielding device that can efficiently shield an image forming device from heat radiated from a heat fixing device while saving space has been desired.

SUMMARY OF THE INVENTION

According to a first aspect of the present invention, an image forming apparatus includes an image forming device including at least one image carrier, configured to form a toner image on the at least one image carrier and transfer the toner image onto a recording medium from the at least one image carrier, a heat fixing device provided adjacent to the image forming device to fix the toner image onto the recording medium by heat, and a heat shielding device configured to shield the image forming device from the heat radiated from the heat fixing device. The heat shielding device includes a heat shielding member interposed between the image forming device and the heat fixing device to receive the heat radiated from the heat fixing device, at least one heat transferring member attached to the heat shielding member on the side of the image forming device to transfer the heat received by the heat shielding member to one end portion of the at least one heat transferring member, at least one heat radiating fin device provided at the one end portion of the at least one heat transferring member to radiate the heat transferred by the at least one heat transferring member, and a fan configured to supply air to the at least one heat radiating fin device to cool the at least one heat radiating fin device.

According to another aspect of the present invention, a method of shielding an image forming device from heat radiated from a heat fixing device in an image forming apparatus, includes receiving the heat radiated from the heat fixing device by a heat shielding member, transferring the heat received by the heat shielding member by at least one heat transferring member to one end portion of the at least one heat transferring member, radiating the heat transferred by the at least one heat transferring member by at least one heat radiating fin device, and supplying air to the at least one heat radiating fin device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1A:
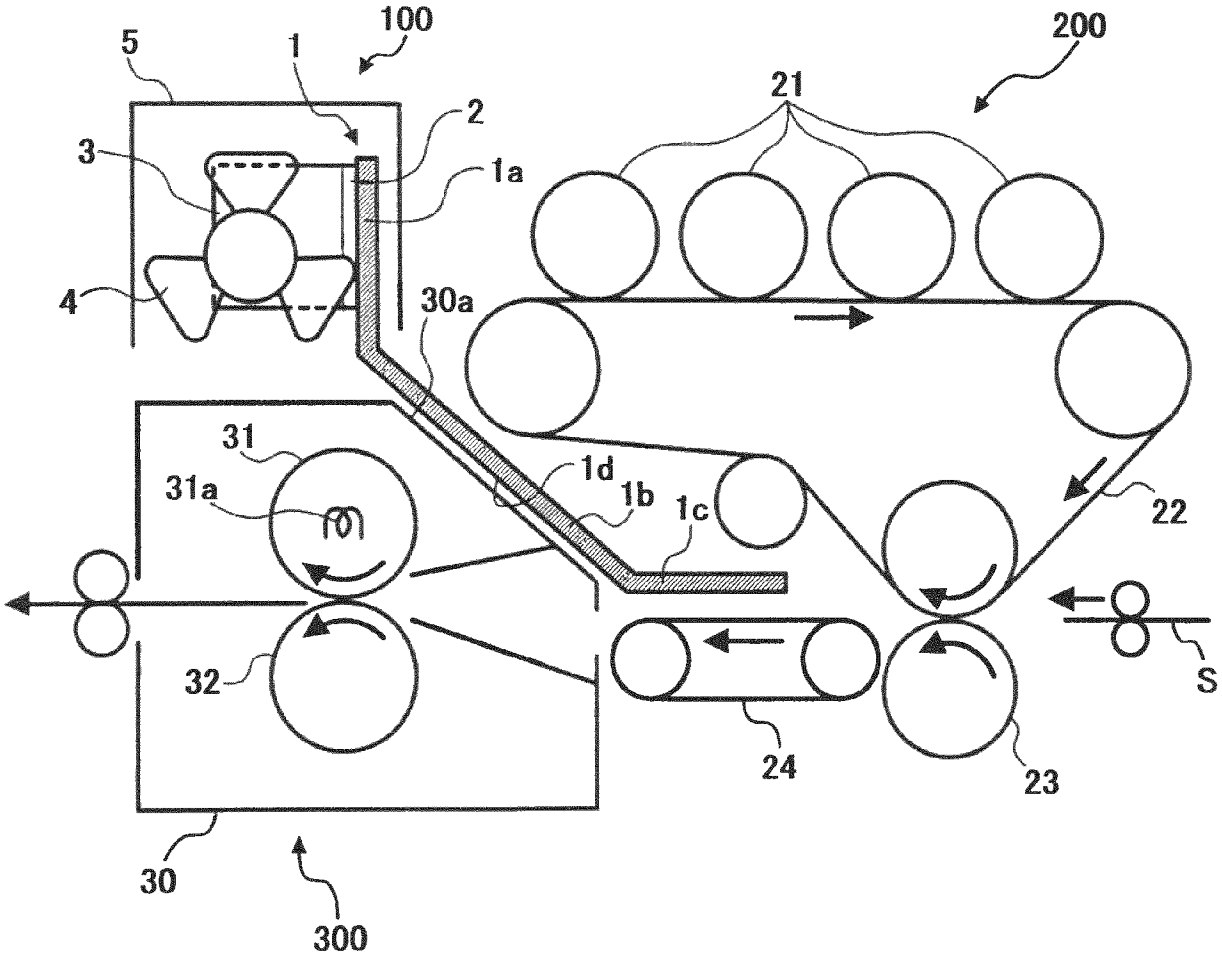
FIG. 1A is a schematic view of a construction of an image forming section in a color image forming apparatus according to one embodiment of the present invention.

Preferred embodiments of the present invention are described in detail referring to the drawings, wherein like reference numerals designate identical or corresponding parts throughout the several views.

Figure 1B:
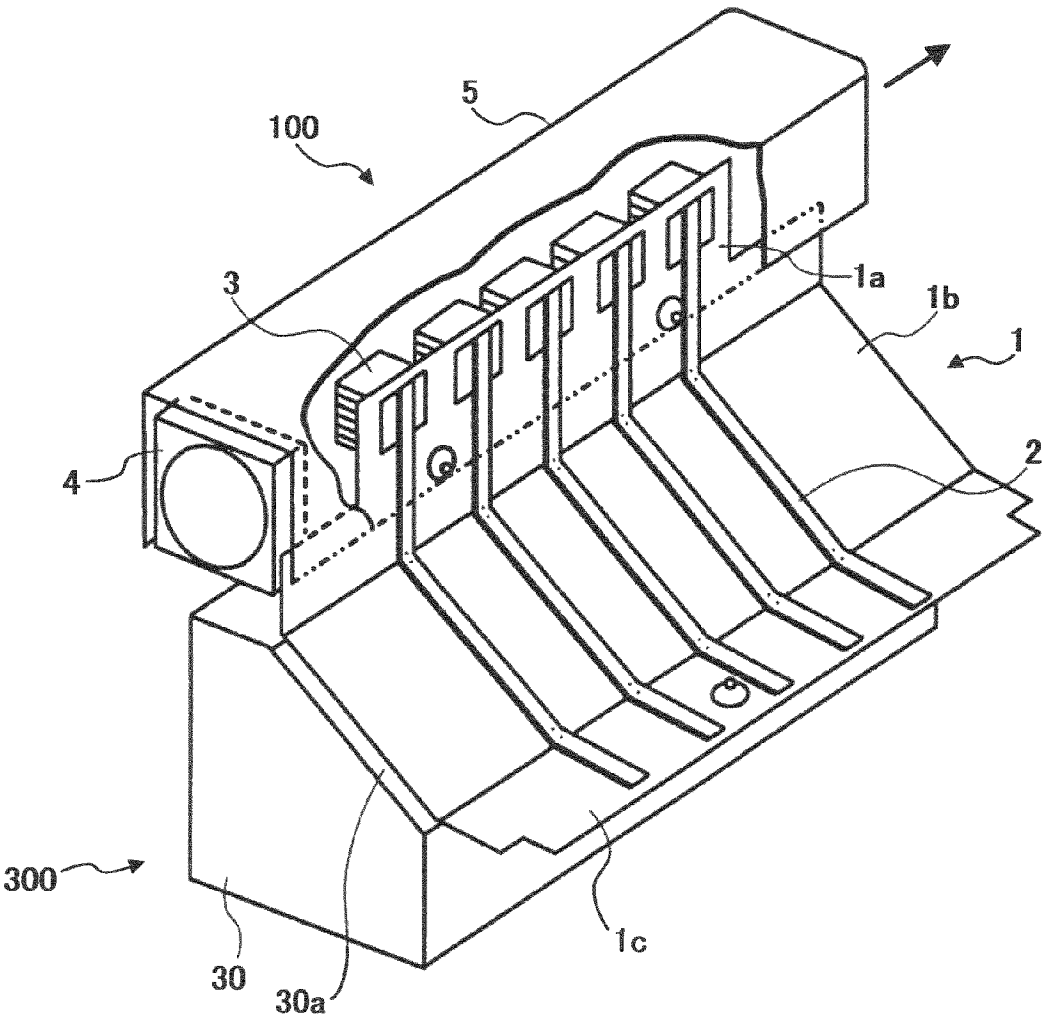
FIG. 1B is a perspective view of a heat fixing device and a heat shielding device in the image forming section of FIG. 1A.

FIG. 1A is a schematic view of a construction of an image forming section in a color image forming apparatus according to one embodiment of the present invention. FIG. 1B is a perspective view of a heat fixing device and a heat shielding device in the image forming section of FIG. 1A.

Referring to FIG. 1A, the image forming section in the color image forming apparatus includes an image forming device 200 having devices for performing an electrophotographic process, a heat fixing device 300 that fixes a toner image onto a recording medium (hereafter referred to as a "transfer sheet") by heat and pressure, and a heat shielding device 100 that shields the image forming device 200 from heat radiated from the heat fixing device 300.

The image forming device 200 includes four photoconductive drums 21 serving as first image carriers arranged in a row; charging devices (not shown); exposure devices (not shown); developing devices (not shown); primary transfer devices (not shown); cleaning devices (not shown); an endless intermediate transfer belt 22 serving as a second image carrier spanned around rollers to move in a direction indicated by the arrows in FIG. 1A; a secondary transfer roller 23; and a sheet conveying belt 24. The charging devices, exposure devices, developing devices, primary transfer devices, and cleaning devices are arranged around the four photoconductive drums 21, respectively.

The heat fixing device 300 includes a heat roller 31 having a heater 31 a inside thereof and a pressure roller 32 in a casing 30. The heat fixing device 300 fixes a toner image onto a transfer sheet by heat and pressure while the transfer sheet carrying the toner image passes through a nip part formed between the heat roller 31 and the pressure roller 32. As shown in FIG. 1A, the diameter of heat roller 31 and pressure roller 32 are each greater than that of the photoconductive drums 21.

A color image of an original document is read by an image reading optical system (not shown), and is then converted into image data by an optoelectronic converter (not shown) and an analog-to-digital (A/D) converter (not shown). The image data is subjected to a necessary image processing. The exposure devices (not shown) expose respective surfaces of the photoconductive drums 21 with a light based on the image data, thereby forming electrostatic latent images for a yellow toner image, a cyan toner image, a magenta toner image, a black toner image on the photoconductive drums 21, respectively.

Subsequently, the developing devices develop the electrostatic latent images on the photoconductive drums 21 with color toner so that each form toner images of different colors (e.g., yellow, cyan, magenta, black). The color toner images are sequentially transferred from the photoconductive drums 21 onto the intermediate transfer belt 22 and are superimposed upon each other thereon. As a result, a superimposed full color toner image is formed on the intermediate transfer belt 22.

Subsequently, the superimposed full color toner image is transferred onto a transfer sheet "S" under the influence of a transfer bias applied from the secondary transfer roller 23. The transfer sheet "S" carrying the toner image is conveyed to the heat fixing device 300 by the sheet conveying belt 24. The heat fixing device 300 fixes the toner image onto the transfer sheet "S" by heat and pressure while the transfer sheet "S" passes through the nip part formed between the heat roller 31 and the pressure roller 32. After the fixing process, the transfer sheet "S" having an image is discharged from the color image forming apparatus.

Generally, when a heat fixing device and an image forming device are arranged close to each other in order to save space in an image forming apparatus, elements in the image forming device may be badly influenced by heat radiated from the heat fixing device. In the present embodiment, in order to prevent the image forming device 200 from being influenced by the heat generated in the heat fixing device 300, a heat shielding plate 1 in the heat shielding device 100 is provided in a small gap between the image forming device 200 and the heat fixing device 300.

The heat shielding plate 1 includes an upper extending part 1*a*, a middle part 1*b*, and a lower extending part 1*c*. The upper extending part 1*a* and the lower extending part 1*c* extend from both edge portions of the middle part 1*b*, respectively, at predetermined angles with respect to the middle part 1*b*. The middle part 1*b* of the heat shielding plate 1 is arranged about parallel and adjacent to an outer surface 30*a* of the casing 30 of the heat fixing device 300, spaced at a predetermined distance apart. As illustrated in FIG. 1A, the outer surface 30*a* of the casing 30 opposite to the image forming device 200 is slanted downwardly. The middle part 1*b* of the heat shielding plate 1 may be arranged in contact with the outer surface 30*a* of the casing 30 of the heat fixing device 300. The heat shielding plate 1 is formed from a material having a heat absorbing property and high thermal conductivity such as aluminum, iron. In view of saving space, it is preferable that the heat shielding plate 1 has a small thickness so as not to deteriorate the thermal conductivity. The heat shielding plate 1 receives the heat radiated from the heat fixing device 300 and conduct the received heat to a low temperature portion thereof.

On a rear surface of the heat shielding plate 1 (i.e., on the opposite side surface of the heat shielding plate 1 relative to the heat fixing device 300), a plurality of heat pipes 2 are attached about parallel to each other at predetermined intervals in a direction perpendicular to the sheet of FIG. 1A. The heat pipes 2 extend across the heat shielding plate 1 (i.e., from the lower extending part 1*c* to the upper extending part 1*a* via the middle part 1*b*). The heat pipes 2 serve as heat transferring members that receive the heat from the heat shielding plate 1 and transfer the heat from a high temperature portion to a low temperature portion thereof. With provision of the plurality of heat pipes 2 on the rear surface of the heat shielding plate 1 as described above, the heat shielding plate 1 may evenly receive the heat radiated from the heat fixing device 300 and the unevenness of temperature of the heat shielding plate 1 may be reduced.

At the upper end portions of the heat pipes 2, a plurality of heat radiating fin devices 3 are fixed via the upper extending part 1*a* of the heat shielding plate 1. Each of the heat radiating fin devices 3 is constructed with a plurality of metallic thin plates having high thermal conductivity arranged about parallel to each other.

The heat radiating fin devices 3 and the upper end portions of the heat pipes 2 are covered by a duct 5 formed from an inverted U-shaped sheet metal. A fan 4 is provided at one end portion of the duct 5 in the longitudinal direction thereof to lead air into the duct 5. The air led into the duct 5 is exhausted from the other end portion of the duct 5.

With the above-described construction of the heat shielding device 100, the heat radiated from the heat fixing device 300 through the casing 30 is received by the heat shielding plate 1 and transferred to the upper end portions of the heat pipes 2. Then, the heat is radiated from the upper end portions of the heat pipes 2 by the heat radiating fin devices 3. The heat radiation by the heat radiating fin devices 3 is facilitated by cooling air supplied into the duct 5 from the fan 4, and thereby heat is exhausted from the duct 5. A volume of air supplied from the fan 4 is preferably about 0.05 $m^3$/min or greater.

In this embodiment, the heat shielding plate 1 with the heat pipes 2 provided in a small gap between the heat fixing device 300 and the image forming device 200, may insulate the image forming device 200 from the heat radiated from the heat fixing device 300.

Figure 2:
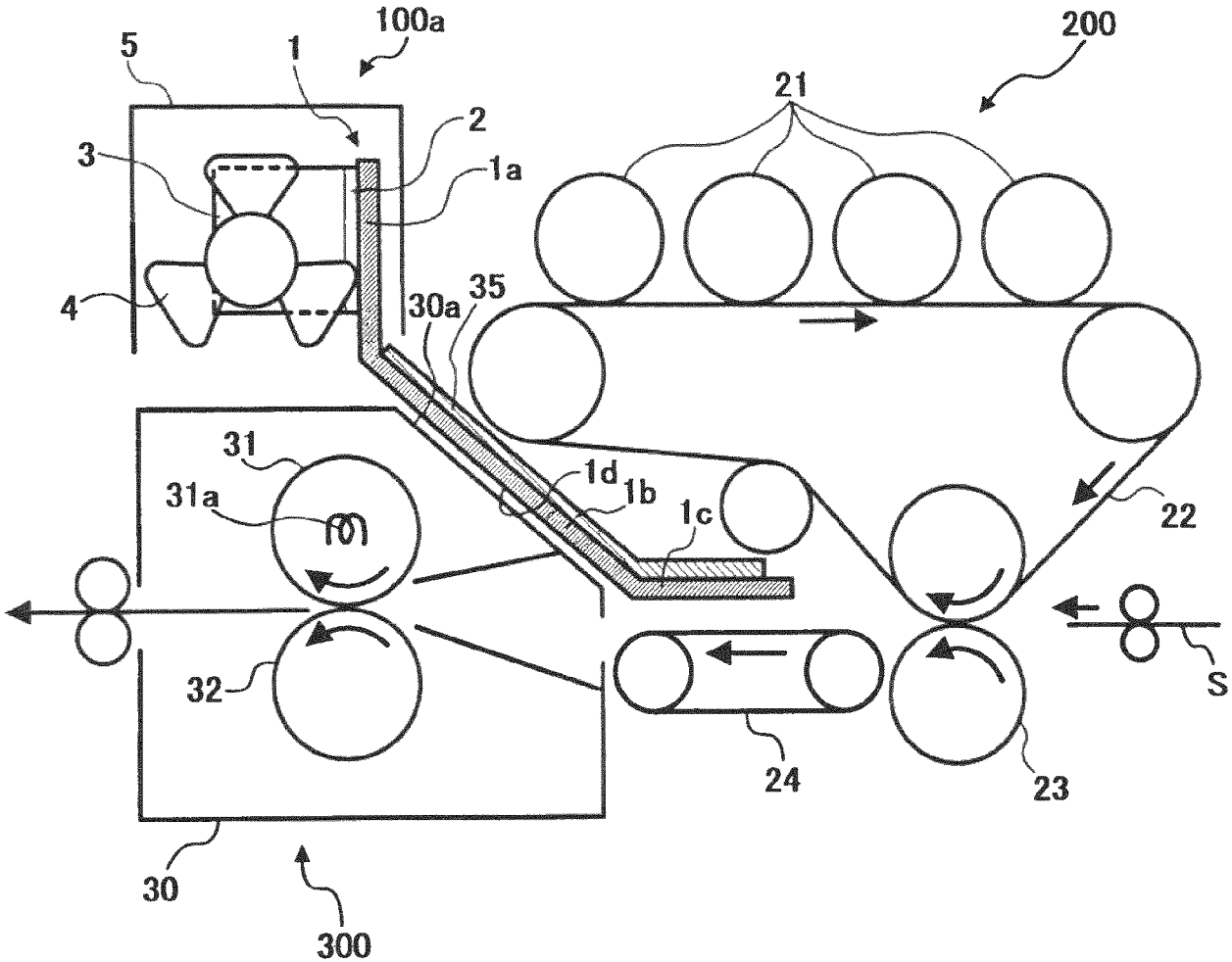
FIG. 2 is a schematic view of a construction of an image forming section including a heat shielding device in a color image forming apparatus according to an alternative example of the present invention.

FIG. 2 is a schematic view of a construction of an image forming section including a heat shielding device in a color image forming apparatus according to an alternative example of the present invention. The image forming section of FIG. 2 has a similar construction to that of the image forming section of FIG. 1A except for a heat insulator 35. A heat shielding device 100*a* includes the heat insulator 35 provided between the heat pipes 2 and the image forming device 200 such that the heat insulator 35 covers a part of the upper surfaces of the heat pipes 2 (i.e., the surfaces of the heat pipes 2 opposite to the image forming device 200) on the middle part 1*b* and the lower extending part 1*c* of the heat shielding plate 1. In this location, the heat insulator 35 serves to prevent the heat received by the heat pipes 2 from being transmitted to the image forming device 200. If the heat insulator 35 is provided between the heat shielding plate 1 and the heat fixing device 300, the heat insulator 35 receives the heat radiated from the heat fixing device 300 instead of the heat shielding plate 1, and the heat pipes 2 cannot sufficiently function as a heat transferring member. As a result, due to insufficient transfer of the heat by the heat pipes 2, the temperature around the heat fixing device 300 gradually increases to approximately a fixing temperature at which a toner image is fixed onto a transfer sheet with time. With provision of the heat insulator 35 between the heat pipes 2 and the image forming device 200, the image forming device 200 may be effectively insulated from the heat radiated from the heat fixing device 300.

Figure 3:
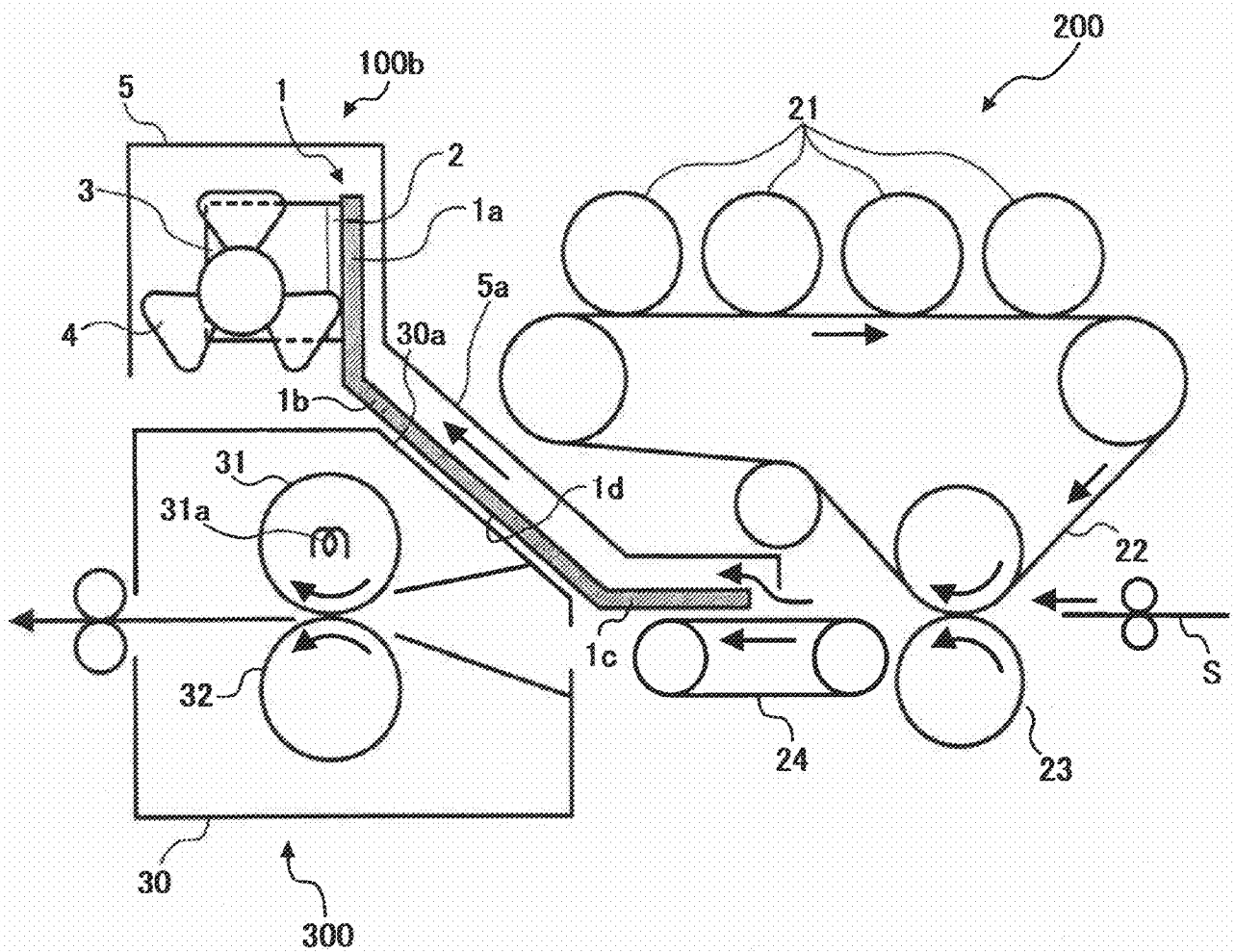
FIG. 3 is a schematic view of a construction of an image forming section including a heat shielding device in a color image forming apparatus according to another alternative example of the present invention.

FIG. 3 is a schematic view of a construction of an image forming section including a heat shielding device in a color image forming apparatus according to another alternative example of the present invention. In a heat shielding device 100*b* of this example, the duct 5 includes an extending part 5*a* which extends so as to be downwardly slanted from a bottom end portion of a vertical right-hand side wall of the duct 5 in FIG. 3. The extending part 5*a* is located in a gap between the middle part 1*b* and the lower extending part 1*c* of the heat shielding plate 1 and the image forming device 200 as a partition member. The fan 4 produces a flow of air indicated by the arrows in FIG. 3 in a space formed between the extending part 5*a* of the duct 5 and the heat shielding plate 1 with the heat pipes 2 so as to facilitate cooling of the heat shielding plate 1 and the heat pipes 2. By cooling the heat shielding plate 1 and the heat pipes 2, the rise of the temperature of the heat shielding plate 1 and the heat pipes 2 with time can be restrained, and thereby the image forming device 200 may be effectively insulated from the heat radiated from the heat fixing device 300.

As an alternative construction of the heat shielding device 100*b* of FIG. 3, the heat insulator 35 used in the heat shielding device 100*a* of FIG. 2 may also be provided on the heat shielding plate 1 with the heat pipes 2 in the heat shielding device 100*b*.

In the above-described heat shielding devices 100, 100*a*, and 100*b*, a surface 1*d* of the heat shielding plate 1 which opposes the heat fixing device 300 may be processed, such that the surface 1*d* has a gloss like a mirror surface, by increasing the smoothness of the surface 1*d* and by plating or a spray-coating. By glossing the surface 1*d* of the heat shielding plate 1, the surface 1*d* may reflect the radiant heat from the casing 30, thereby decreasing the transmission of heat from the heat fixing device 300 to the image forming device 200.

Alternatively, the surface 1*d* may be processed into a black color or a dark color by a surface process or by a spray coating. By making the surface 1*d* of the heat shielding plate 1 into a black color or a dark color, the heat shielding plate 1 may absorb the heat radiated from the heat fixing device 300, thereby decreasing the transmission of heat from the heat fixing device 300 to the image forming device 200.

Figure 4:
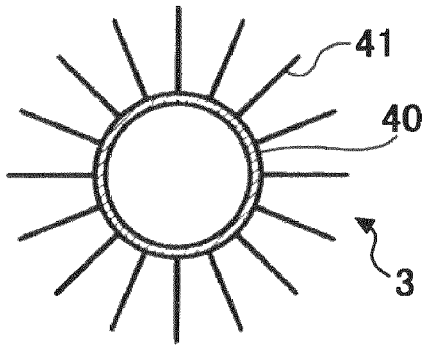
FIG. 4 is a cross-sectional view of an exemplary construction of a heat radiating fin device in the heat shielding devices of FIG. 1B, FIG. 2, and FIG. 3.

FIG. 4 is a cross-sectional view of an exemplary construction of the heat radiating fin device 3 in the heat shielding devices 100, 100*a*, and 100*b*. As illustrated in FIG. 4, the heat radiating fin device 3 includes a cylindrical metallic tube 40 and a plurality of plate-shaped fins 41 provided around the circumferential surface of the metallic tube 40 in a radially protruding condition. The heat radiating fin device 3 is constructed such that air flows in the metallic tube 40.

An end surface of the metallic tube 40 is fixed onto an upper end portion of the upper extending part 1*a* of the heat shielding plate 1 such that the plate-shaped fins 41 of the heat radiating fin device 3 do not interfere with the plate-shaped fins 41 of the adjacent heat radiating fin device 3. By use of the hollow heat radiating fin device 3 and by flowing air in the metallic tube 40 of the heat radiating fin device 3, the cooling efficiency of the heat radiating fin device 3 may be enhanced, and an upper end portion of the heat pipe 2 may be efficiently cooled.

Figure 5:
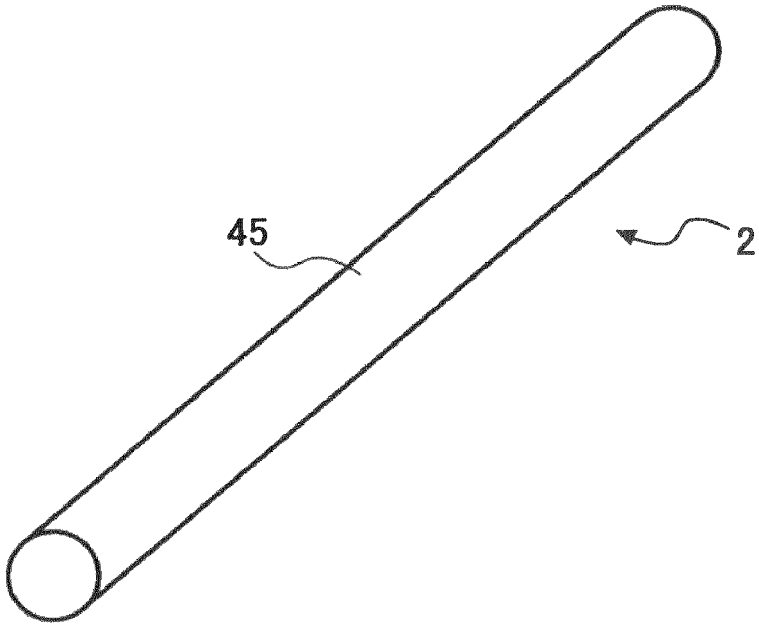
FIG. 5 is a perspective view of an exemplary heat pipe for use in the heat shielding devices of FIG. 1B, FIG. 2, and FIG. 3.

FIG. 5 is a perspective view of an exemplary heat pipe 2 for use in the heat shielding devices 100, 100*a*, and 100*b*. The heat pipe 2 is formed from, for example, a sealed copper tube 45 containing a small quantity of pure water. Because the heat pipe 2 is formed from the copper tube 45, the efficiency of the heat transfer of the heat pipe 2 may be enhanced. Further, by use of pure water instead of chlorofluorocarbons as a filling material in the copper tube 45, it is advantageous in environmental protection.

Figure 6:
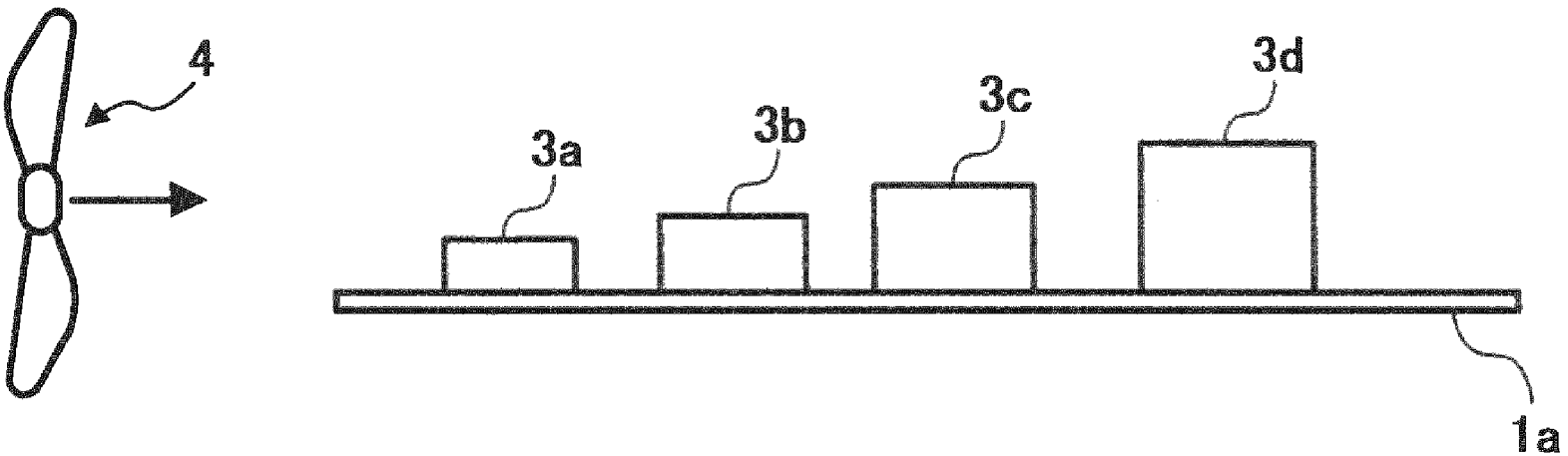
FIG. 6 is a top view of an exemplary construction of the heat radiating fin devices in the heat shielding devices of FIG. 1B, FIG. 2, and FIG. 3.

FIG. 6 is a top view of an exemplary construction of the heat radiating fin devices 3 in the heat shielding devices 100, 100*a*, and 100*b*. As illustrated in FIG. 6, a plurality of heat radiating fin devices 3*a*, 3*b*, 3*c*, 3*d* are provided at the upper end portion of the upper extending part 1*a* of the heat shielding plate 1 such that each length of the heat radiating fin devices 3*a*, 3*b*, 3*c*, 3*d* protruding from the upper extending part 1*a* of the heat shielding plate 1 gradually increases as the positions of the heat radiating fin devices 3*a*, 3*b*, 3*c*, 3*d* are away from the fan 4. With this arrangement of the heat radiating fin devices 3*a*, 3*b*, 3*c*, 3*d*, even the heat radiating fin device 3*d*, which is located at the farthest position from the fan 4, may receive a sufficient amount of air supplied from the fan 4. As a result, the temperature difference between the heat radiating fin devices 3*a*, 3*b*, 3*c*, 3*d* may be decreased. Therefore, the heat conducted by the heat shielding plate 1 and transferred by the heat pipes 2 may be efficiently radiated from the heat radiating fin devices 3*a*, 3*b*, 3*c*, 3*d*.

Figure 7:
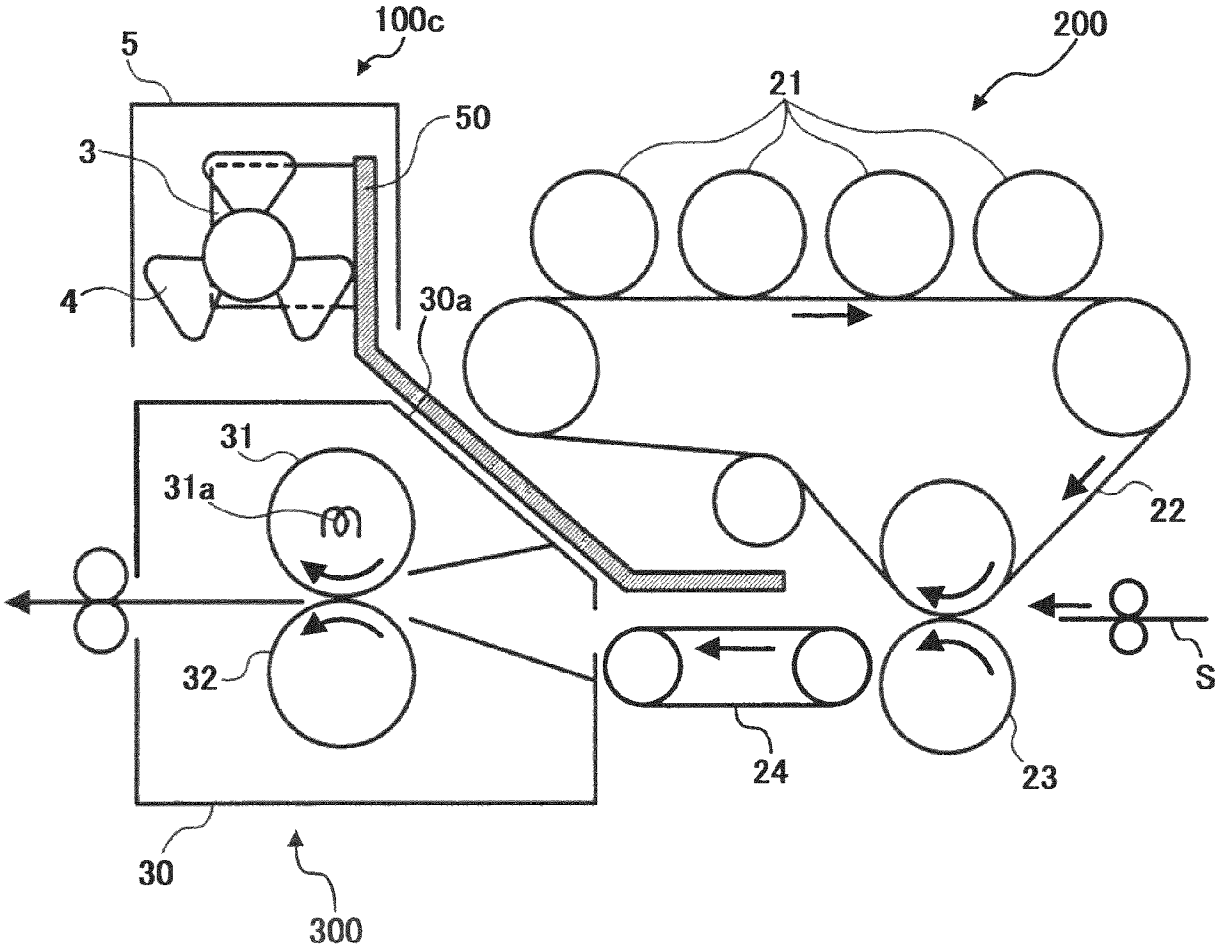
FIG. 7 is a schematic view of a construction of an image forming section including a heat shielding device in a color image forming apparatus according to another alternative example of the present invention.

FIG. 7 is a schematic view of a construction of an image forming section including a heat shielding device in a color image forming apparatus according to another alternative example of the present invention. A heat shielding device 100*c* of this example uses a heat panel 50 in place of the heat shielding plate 1 and the heat pipe 2. As illustrated in FIG. 7, the heat panel 50 is interposed between the heat fixing device 300 and the image forming device 200 to insulate the image forming device 200 from the heat radiated from the heat fixing device 300. The heat panel 50 is formed from, for example, a hollow metal plate having a predetermined thickness. A small quantity of filling material such as pure water and chlorofluorocarbons is sealed in the hollow metal plate. In the heat shielding device 100*c*, by use of the heat panel 50, a distribution of temperature of the heat panel 50 may be even. As a result, the image forming device 200 may be efficiently insulated from the heat radiated from the heat fixing device 300. Further, because the heat panel 50 serves as both the heat shielding/receiving member (i.e., the heat shielding plate 1) and the heat transferring member (i.e., the heat pipes 2), the heat shielding device 100*c* may have a simple construction. The heat shielding devices 100*a* and 100*b* may use the heat panel 50 in the heat shielding device 100*c* in place of the heat shielding plate 1 and the heat pipes 2. The examples of the heat radiating fin devices 3 and the heat pipe 2 described referring to FIGS. 4 through 6 may be used in the heat shielding device 100*c* in FIG. 7.

According to the above-described embodiment and examples, the heat shielding plate 1 and the heat pipes 2 are arranged in a small gap between the heat fixing device 300 and the image forming device 200. The heat shielding plate 1 and the heat pipes 2 are effectively cooled by providing the heat radiating fin devices 3 at the end portions of the heat pipes 2. With the air-cooling of the heat radiating fin devices 3 by the fan 4, the size of the heat radiating fin devices 3 may be made small.

The present invention has been described with respect to the embodiments as illustrated in the figures. However, the present invention is not limited to the embodiments and may be practiced otherwise.

The above-described heat shielding devices 100, 100*a*, 100*b*, 100*c* are applied to a multi-color image forming apparatus. Alternatively, the heat shielding devices 100, 100*a*, 100*b*, 100*c* may be applied to other similar apparatuses, such as to a single color image forming apparatus.

Moreover, the above-described heat shielding devices 100, 100*a*, 100*b*, 100*c* may shield devices in the image forming apparatus other than the image forming device 200 from the heat generated in the heat fixing device 300.

Numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. An image forming apparatus, comprising:

an image forming device including four photoconductive drums to form a toner image and an endless intermediate transfer belt contacted on an upper surface thereof by the photoconductive drums;

a heat fixing device provided adjacent the image forming device to fix the toner image onto a recording medium by heat, the heat fixing device including a casing having a casing surface portion that is slanted relative to a horizontal plane and including a heating member having a heater inside thereof to heat the recording medium, and a pressure member configured to apply pressure to the recording medium; and a heat shielding device configured to shield the image forming device from heat radiated from the heat fixing device, and interposed between the image forming device and the heat fixing device to receive the heat radiated from the heat fixing device, the heat shielding device including an upper part, a middle part, and a lower part, the lower part extending at a non-zero angle from a portion of the middle part which faces the heat fixing device, the middle part being slanted at an angle corresponding to the slanted casing of the heat fixing device, and the upper part extending at a non-zero angle from a portion of the middle part which faces the heat fixing device, wherein excluding side walls, the middle part includes at least two walls, and the lower part includes at least three walls which are different from the at least two walls of the middle part; and a fan being located adjacent an end portion of said endless intermediate transfer belt, and wherein the heat fixing device is positioned under the photoconductive drums, wherein the heat shielding device comprises a surface facing the heat fixing device and having a black color or a dark color.

2. The image forming apparatus of claim 1, wherein a portion of the heat shielding member is arranged adjacent to and substantially parallel with the casing surface portion at a predetermined distance away.

3. The image forming apparatus of claim 2, wherein at least a portion of the casing of the heat fixing device is substantially parallel with a portion of said endless intermediate transfer belt which engages said photoconductive drums.

4. The imager forming apparatus of claim 2, wherein said fan is positioned such that a flow direction thereof is substantially parallel with an axis of rotation of at least one of said heating member and said pressure member.

5. The image forming apparatus of claim 1, wherein at least a portion of the casing of the heat fixing device is substantially parallel with a portion of said endless intermediate transfer belt which engages said photoconductive drums.

6. The image forming apparatus of claim 1, wherein said fan is positioned above said heat fixing device and adjacent an end portion of said endless intermediate transfer belt.

7. The image forming apparatus of claim 1, wherein said fan is positioned such that a flow direction thereof is substantially parallel with an axis of rotation of at least one of said heating member and said pressure member.

8. The image forming apparatus of claim 1, wherein the heat fixing device comprises a heat roller and a pressure roller and wherein said fan is positioned such that a flow direction thereof is substantially parallel with an axis of rotation of at least one of said heat roller and said pressure roller.

9. An image forming apparatus, comprising:

an image forming device including plural photoconductive drums configured to form a toner image and an endless intermediate transfer belt contacted on an upper surface thereof by the photoconductive drums;

a heat fixing device configured to fix the toner image onto a recording medium, the heat fixing device being positioned under the plural photoconductive drums;

a heat shielding member interposed between the image forming device and the heat fixing device; and a heat pipe mounted on the heat shielding member.

10. The image forming apparatus of claim 9, wherein the heat shielding member is concave in shape in a direction towards the photoconductive drums.

11. An image forming apparatus, comprising:

an image forming device including four photoconductive drums configured to form a toner image and an endless intermediate transfer belt contacted on an upper surface thereof by the photoconductive drums;

means for fixing, proximate to the image forming device, the toner image onto a recording medium by heat, the means for fixing including a casing having a casing surface portion that is slanted relative to a horizontal plane;

means for shielding the image forming device from heat radiated from the means for fixing, the means for shielding disposed between the means for fixing and the image forming device; and a fan configured to cool the image forming apparatus, wherein the means for fixing is positioned at a level which is lower than a level of the photoconductive drums, and wherein the means for shielding comprises a surface facing the means for fixing and having a black color or a dark color, the means for shielding including an upper part, a middle part, and a lower part, the lower part having a side which extends downwardly at a non-zero angle from a portion of the middle part which faces the means for fixing, the middle part being slanted at an angle corresponding to the slanted casing of the means for fixing, and the upper part extending at a non-zero angle from a portion of the middle part which faces the means for fixing, wherein excluding side walls, the middle part includes at least two walls, and the lower part includes at least three walls which are different from the at least two walls of the middle part.

12. An image forming apparatus according to claim 11, wherein:

the fan is configured to remove heat by exhausting heat generated by the means for fixing.

13. An image forming apparatus according to claim 11, wherein:

the fan is configured to transfer cooling air to prevent heat generated by the means for fixing from reaching the endless intermediate transfer belt.

14. An image forming apparatus according to claim 11, wherein:

the fan is adjacent an end portion of said endless intermediate transfer belt.

15. An image forming apparatus, comprising:

an image forming device including a plurality of photoconductive drums each arranged in a row above an endless intermediate transfer belt to form a toner image;

a heat fixing device to fix the toner image onto a recording medium by heat, the heat fixing device including a casing having a casing surface portion that is slanted relative to a horizontal plane; and a heat shielding device provided between the image forming device and the heat fixing device and spaced at a distance apart from the casing surface portion of the casing of the heat fixing device, wherein the heat shielding device includes an upper part, a middle part, and a lower part, the lower part having a side which extends downwardly at a non-zero angle from a portion of the middle part which faces the heat fixing device, the middle part being slanted at an angle corresponding to the slanted casing of the heat fixing device, and the upper part extending at a non-zero angle from a portion of the middle part which faces the heat fixing device, wherein excluding side walls, the middle part includes at least two walls, and the lower part includes at least three walls which are different from the at least two walls of the middle part.

16. The image forming apparatus of claim 15, further comprising:

a sheet conveying belt provided between a secondary transfer roller of the image forming device and the heat fixing device, and configured to transfer the recording medium carrying the toner image formed by the image forming device to the heat fixing device.

17. The image forming apparatus of claim 15, wherein the heat shielding device comprises a duct.

18. The image forming apparatus of claim 15, wherein a surface of the heat shielding device facing the heat fixing device comprises a surface opposite to the image forming device that is slanted relative to the horizontal plane.

19. The image forming apparatus of claim 15, wherein the heat shielding device comprises a heat insulator.

20. The image forming apparatus of claim 15, wherein the heat shielding device comprises a surface facing the heat fixing device and having a black color or a dark color.

21. The image forming apparatus of claim 15, wherein the fixing device is provided at a position that is lower than a position where the plurality of photoconductive drums is provided.

22. The image forming apparatus of claim 15, wherein the heat fixing device includes:

a heating member having a heater therein and configured to heat the recording medium; and a pressure member configured to apply pressure to the recording medium when the recording medium is between the heating member and pressure member.

* * * * *